US010248068B2

(12) United States Patent
Matsumoto

(10) Patent No.: US 10,248,068 B2
(45) Date of Patent: Apr. 2, 2019

(54) IMAGE FORMING APPARATUS

(71) Applicant: CANON KABUSHIKI KAISHA, Tokyo (JP)

(72) Inventor: Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/642,169

(22) Filed: Jul. 5, 2017

(65) Prior Publication Data

US 2018/0017922 A1 Jan. 18, 2018

(30) Foreign Application Priority Data

Jul. 13, 2016 (JP) ..... 2016-138746

(51) Int. Cl.
*G03G 15/00* (2006.01)
*G03G 15/08* (2006.01)

(52) U.S. Cl.
CPC ..... *G03G 15/556* (2013.01); *G03G 15/0853* (2013.01)

(58) Field of Classification Search
CPC ..... G03G 15/556; G03G 15/0822–15/0829; G03G 15/0849–15/0855; G03G 15/0844; G03G 15/0848; G03G 15/0851; G03G 15/0853
See application file for complete search history.

(56) References Cited

U.S. PATENT DOCUMENTS 5,839,018 A * 11/1998 Asanuma ..... G03G 15/0849 399/43
2006/0239701 A1* 10/2006 Ishibashi ..... G03G 15/0194 399/30
2008/0181638 A1* 7/2008 Fujioka ..... G03G 15/0853 399/58
2011/0043588 A1* 2/2011 Shukuya ..... G03G 15/0131 347/116
2012/0230707 A1* 9/2012 Shigehiro ..... G03G 15/0851 399/27
2014/0255047 A1* 9/2014 Hirobe ..... G03G 15/0824 399/27

FOREIGN PATENT DOCUMENTS

JP 01-182750 A 7/1989
JP 05-027527 A 2/1993
JP 06-149057 A 5/1994
JP 2011-48118 A 3/2011

* cited by examiner

*Primary Examiner* — Carla J Therrien
(74) *Attorney, Agent, or Firm* — Canon USA, Inc., IP Division

(57) ABSTRACT

An image forming apparatus determines a toner density erroneous detection state based on a patch image density in patch detection auto toner replenishing and, when the toner density erroneous detection state is determined, offsets a target toner density by the amount of erroneous detection so that the actual toner density becomes a desired toner density.

9 Claims, 13 Drawing Sheets

IMAGE FORMING APPARATUS

BACKGROUND

Field of the Disclosure

The present disclosure generally relates to image forming and, more particularly, to an image forming apparatus, and a development device for developing an electrostatic latent image formed on an image bearing member, such as a photosensitive drum, by using a developer containing a toner and a carrier.

Description of the Related Art

Image forming apparatuses for developing an electrostatic latent image on a photosensitive member to a toner image by using a developer (two-component developer) mainly including a (non-magnetic) toner and a (magnetic) carrier are widely used. In a development device using a two-component developer, the toner density of a toner in the developer is adjusted to maintain a constant toner charge amount so that an electrostatic latent image formed under predetermined charge/exposure conditions is developed with a predetermined toner application amount.

A toner charge amount is maintained constant by the following control. A decrease in the toner charge amount increases the toner application amount and leads to an increase in the image density even in a case where identical electrostatic latent images are developed. The ratio of the toner amount is therefore decreased to increase the friction of the developer so that the toner charge amount is increased. Conversely, an increase in the toner charge amount decreases the toner application amount and leads to a decrease in the image density even in a case where identical electrostatic latent images are developed. The toner density is therefore increased to reduce the friction of the developer so that the toner charge amount is decreased. This control is discussed in Japanese Patent Application Laid-Open No. 01-182750, Japanese Patent Application Laid-Open No. 06-149057, Japanese Patent Application Laid-Open No. 05-027527, and Japanese Patent Application Laid-Open No. 2011-48118.

Japanese Patent Application Laid-Open No. 01-182750 discusses a detection unit employing a magnetic permeability sensor (inductance sensor) for outputting a signal according to the toner density by using the phenomenon that an increase in the ratio of a carrier increases the magnetic permeability of a developer (two-component developer).

Japanese Patent Application Laid-Open No. 06-149057 discusses an optical sensor for irradiating a patch image formed in an image interval between images currently being successively formed with light emitting diode (LED) light, detecting the amount of normal reflected light, and outputting a signal corresponding to the toner application amount of the patch image. In this case, to allow the toner application amount of the patch image formed under predetermined charge/exposure conditions to converge to a predetermined value, the toner density of the developer (two-component developer) is changed by replenishing a supplemental developer into a development container. This method is what is called patch detection auto toner replenishing (ATR).

Japanese Patent Application Laid-Open No. 05-027527 discusses a video count unit for cumulatively counting the number of developed dots in an entire binary-modulated image supplied to a light source of the exposure device. In this case, the video count unit processes image data and an exposure signal subjected to image forming to calculate the toner amount to be consumed to develop one image, and supplies the supplemental developer of the amount suitable for the toner amount to be consumed to prevent variation in the ratio of the toner in a developer.

Japanese Patent Application Laid-Open No. 2011-48118 discusses a control method using an inductance control unit, a video count control unit, and patch detection ATR control to stabilize the output image density with a favorable balance. In the control method, the video count unit calculates the amount of toner to be replenished equivalent to an expected toner consumption amount on a feedforward basis. Also, the inductance control unit corrects a difference in the toner density from a reference value on a feedback basis. For example, when the inductance control unit is used as a single unit in a case of a large toner consumption amount, the toner density may decrease more than expected because of a detection delay due to a time lag until the replenished toner reaches the inductance control unit after toner replenishment. Therefore, from the viewpoint of the improvement in the accuracy of toner replenishment, it is desirable to determine an approximate amount of toner to be replenished based on video count information and correct the amount of toner by using inductance information. In the control method, a target value of the inductance control unit is also suitably changed according to the target toner density obtained through patch detection ATR control. It is well known that, even with the same toner density, toner adhesion to the carrier surface degrades the carrier charging performance, and accordingly the toner charge amount moderately decreases according to the use endurance. Therefore, it is desirable to change the target toner density value in inductance control through low-frequency patch detection ATR control. More specifically, the target toner density value in inductance control is changed according to the difference between the patch image density and a predetermined target patch image density (or a target patch image density obtained through a predetermined procedure) to change the charge amount of the developer, thus maintaining a constant patch image density. As described above, a decrease in the toner charge amount increases the toner application amount and leads to an increase in the image density even for an identical electrostatic latent image. This means that maintaining a constant patch image density is equivalent to maintaining a constant charge amount of the developer.

In this case, although various target toner density values are determined to maintain a constant patch image density, not all desired values can be used to maintain a constant patch image density. Japanese Patent Application Laid-Open No. 2011-48118 discusses preventing undesired values from being determined by providing an upper limit value and a lower limit value for a target toner density.

Combining the above-described three different control methods enables the output image density to stabilize without remarkably degrading productivity, even in a case of a large toner consumption amount or in a case where the carrier charging performance changes according to the use endurance.

However, even if the control method discussed in Japanese Patent Application Laid-Open No. 2011-48118 is used, the stability of the output image density is sometimes degraded by erroneous detection of the signal of an inductance sensor depending on the printing ratio of the output image. More specifically, if images having a high printing ratio (hereinafter referred to as high-printing ratio images) are continuously printed for a prolonged period of time, toner replenishment accompanying a large amount of toner consumption is performed highly frequently. In this case, the stirring time is shortened, and as a result, the toner charge amount is decreased. An increase in the amount of toner having a low charge amount increases the bulk density of the developer in the developing device, and accordingly increases the apparent magnetic permeability by the inductance sensor. Thus, the inductance sensor erroneously detects the increase in the ratio of the carrier in the developer and therefore outputs a comparatively low toner density. Since the detected toner density is lower than the actual toner density, the actual toner density becomes higher than the desired toner density by the amount of erroneous detection even if the toner density is set to the lower limit value. If such erroneous detection occurs, the image stability is liable to be degraded.

When the printing ratio of the output image is low, the result is the contrary to the above-described one. If images having a low printing ratio (hereinafter referred to as low-printing ratio images) are continuously printed for a prolonged period of time, a small amount of toner is replaced in the developing device. Accordingly, the frictional charge between a toner and a carrier becomes excessive and a toner charge amount becomes large. With the increase in the amount of toner having a high charge amount, the bulk density of the developer decreases, and accordingly the apparent magnetic permeability by the inductance sensor decreases. As a result, the inductance sensor erroneously detects the decrease in the ratio of the carrier in the developer and outputs a comparatively high toner density. In this case, the actual toner density becomes lower than the desired toner density by the amount of erroneous detection even if the toner density is set to the upper limit value. If such erroneous detection occurs, the image stability is liable to be degraded.

SUMMARY

One or more aspects of the present disclosure provide an image forming apparatus capable of providing an improved image stability even with an unstable accuracy of detecting the toner density in a development device based on the magnetic permeability.

According to one or more aspects of the present disclosure, an image forming apparatus includes an image bearing member, a developer bearing member configured to bear a developer including a toner and a carrier and develop an electrostatic latent image formed on the image bearing member, a development device provided with the developer bearing member and configured to store the developer, a toner density detection unit configured to detect ratios of the toner and the carrier in the development device based on a magnetic permeability, a replenishment unit configured to replenish the developer to the development device to maintain the ratio of the toner to the carrier within a range between an upper limit value and a lower limit value, based on the toner density detection unit, an intermediate transfer member configured to bear an image formed on the image bearing member to transfer the image to a recording material, an image density detection unit configured to detect a density of a detection image formed on either the image bearing member or the intermediate transfer member, and a change unit configured to change the lower limit value of the ratio to a first lower limit value when the density of the detection image detected by the image density detection unit is a first density, the first density being a reference value, and change the lower limit value of the ratio to a second lower limit value smaller than the first lower limit value when the density of the detection image detected by the image density detection unit is a second density higher than the first density.

Further features of the present disclosure will become apparent from the following description of exemplary embodiments with reference to the attached drawings.

DESCRIPTION OF THE EMBODIMENTS

An image forming apparatus according to one or more aspects of the present disclosure will be described in more detail below with reference to the accompanying drawings.

<Overview of Image Forming Apparatus>

Figure 1:
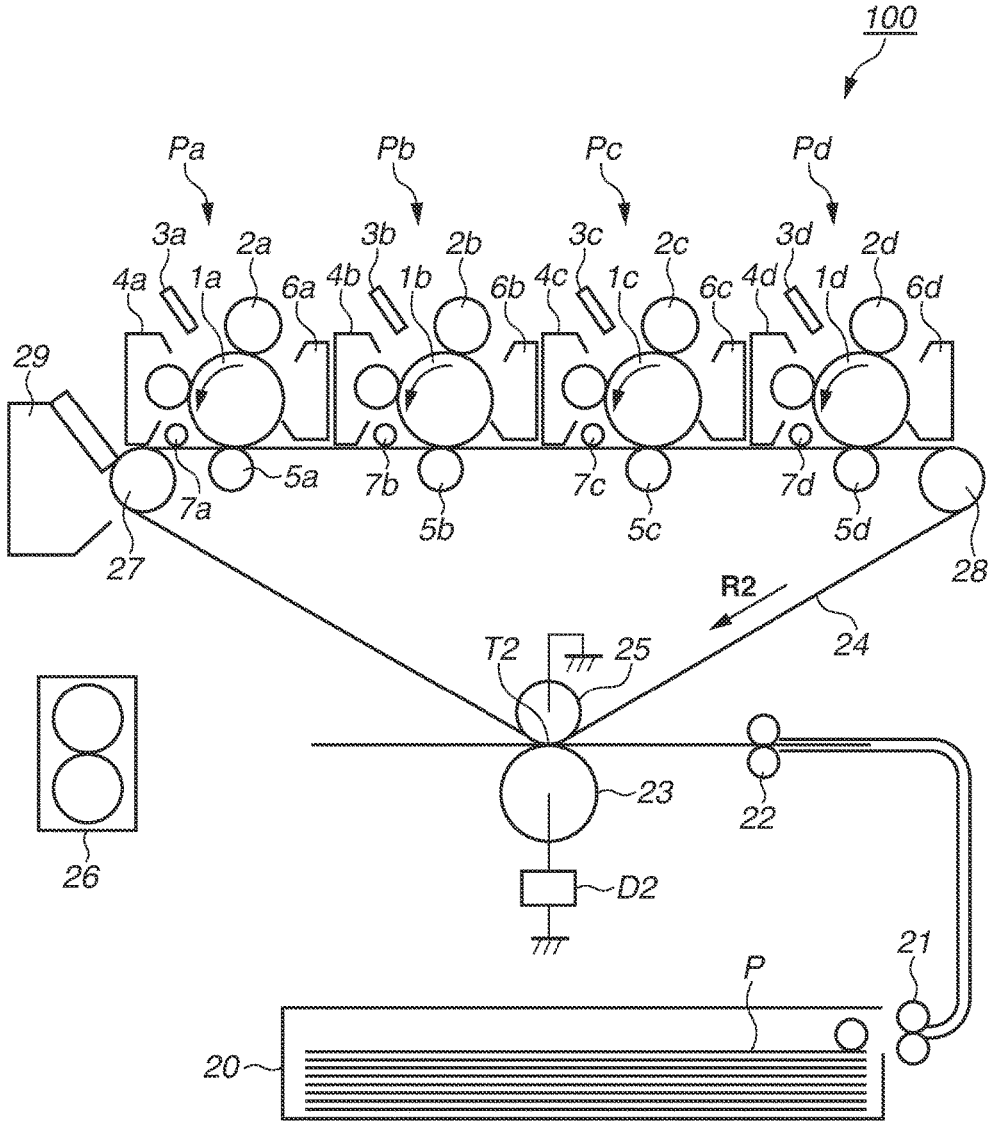
FIG. 1 illustrates a configuration of an image forming apparatus.
Figure 2:
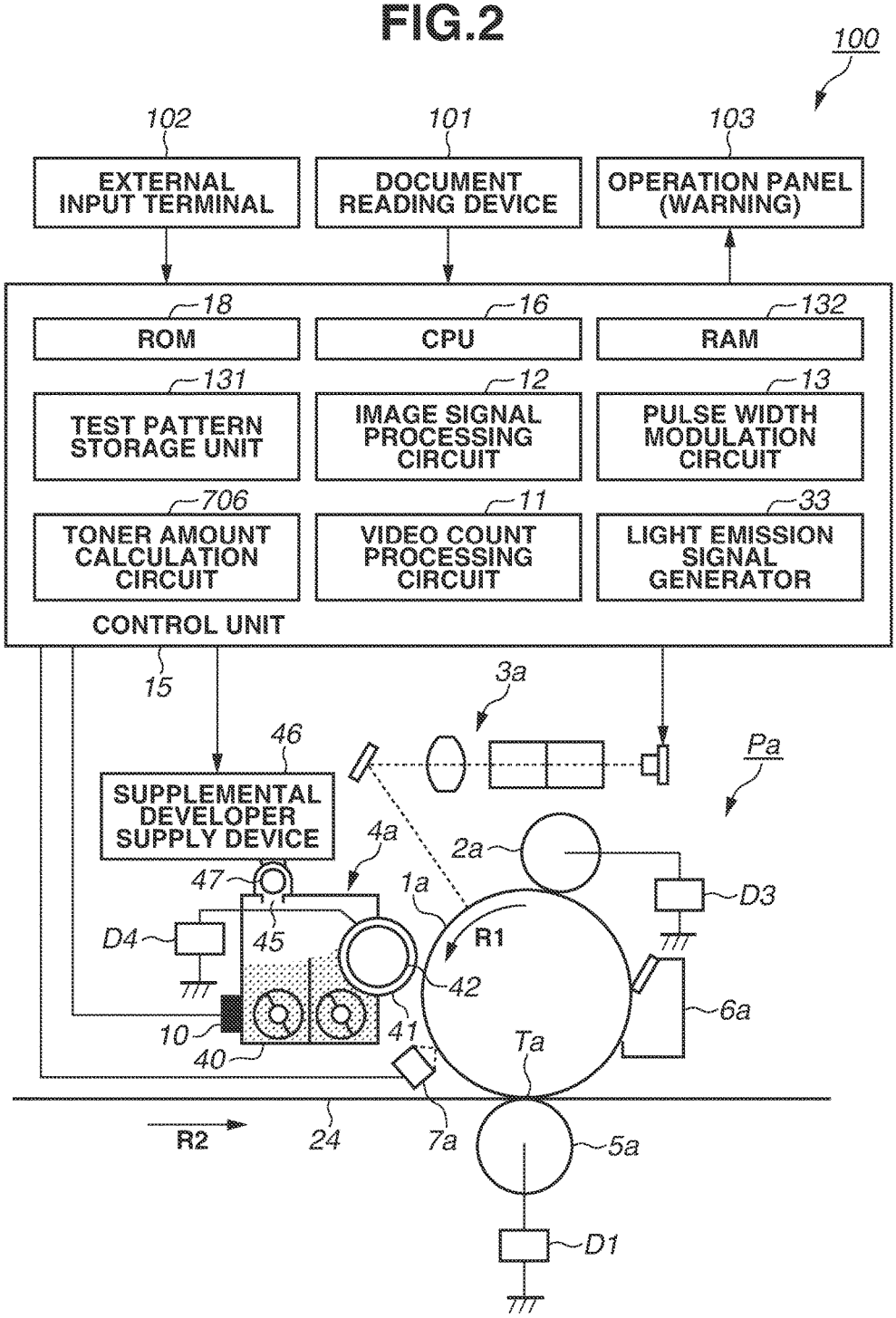
FIG. 2 illustrates a configuration of a yellow image forming unit.

FIG. 1 illustrates a configuration of an image forming apparatus according to one or more aspects of the present disclosure. FIG. 2 illustrates a configuration of a yellow image forming unit according to one or more aspects of the present disclosure.

As illustrated in FIG. 1, an image forming apparatus 100 is a tandem intermediate transfer type full color printer including a yellow image forming unit Pa, a magenta image forming unit Pb, a cyan image forming unit Pc, and a black image forming unit Pd juxtaposed along an intermediate transfer belt 24. In the image forming unit Pa, a yellow toner image is formed on a photosensitive drum 1*a* and then primarily transferred onto the intermediate transfer belt 24. In the image forming unit Pb, a magenta toner image is formed on a photosensitive drum 1*b* and then primarily transferred onto the intermediate transfer belt 24 so that the magenta toner image is superimposed with the yellow toner image. In the image forming units Pc and Pd, a cyan and a black toner images are formed on photosensitive drums 1*c* and 1*d*, respectively, and then primarily transferred on the intermediate transfer belt 24 in a superimposed way.

The units described throughout the present disclosure are exemplary and/or preferable modules for implementing processes described in the present disclosure. The modules can be hardware units (such as circuitry, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

The four color toner images primarily transferred onto the intermediate transfer belt 24 are conveyed to a secondary transfer portion T2 and then secondarily transferred onto a recording material P at one time. The recording material P pulled out from a recording material cassette 20 is separated by a separation roller 21 and then sent out to a registration roller 22. The registration roller 22 receives the recording material P and waits in a stop condition, and, in synchronization with the toner image on the intermediate transfer belt 24, sends the recording material P into the secondary transfer portion T2.

The recording material P with the 4-color toner image secondarily transferred thereon is heated and pressurized by a fixing device 26 and then discharged out of the apparatus.

The image forming units Pa, Pb, Pc, and Pd have substantially almost the same configuration except that the development devices 4*a*, 4*b*, 4*c*, and 4*d* use toner of different colors, yellow, magenta, cyan, and black, respectively. The following describes only the image forming unit Pa. For the image forming units Pb, Pc, and Pd, the trailing character "a" of the reference numerals of the image forming unit Pa and the components thereof are to be replaced with "b", "c", and "d", respectively.

The intermediate transfer belt 24, stretched and supported by a tension roller 27, a drive roller 28, and an opposing roller 25, is driven by the drive roller 28 to rotate in the direction of an arrow R2 at a process speed of 300 mm/second. A secondary transfer roller 23 contacts the intermediate transfer belt 24 at the position where an inner circumferential surface of the intermediate transfer belt 24 is supported by the opposing roller 25, to form the secondary transfer portion T2. When the secondary transfer roller 23 is applied with a direct-current (DC) voltage from a power source D2, a toner image borne by the intermediate transfer belt 24 is secondarily transferred onto the recording material P. A belt cleaning device 29 rubs the intermediate transfer belt 24 by using a cleaning blade to collect transfer residual toner that has not been transferred onto the recording material P and has passed through the secondary transfer portion T2 and remained on the intermediate transfer belt 24.

As illustrated in FIG. 2, a document to be copied is read by the document reading device 101. The document reading device 101 includes a photoelectric conversion element, such as a charge coupled device (CCD), for converting a document image into an electrical signal, and outputs image signals corresponding to yellow image information, magenta image information, cyan image information, and black image information of the document to be copied.

FIG. 2 further illustrates an external input terminal 102, an operation panel 103, a control unit 15, a supplemental developer supply device 46, and the image forming unit Pa. The control unit includes a video count processing unit 11, an image signal processing circuit 12, a pulse width modulation circuit 13, a light emission signal generator 33, a test pattern storage unit 131, and a toner amount calculation circuit 706. The control unit 15 controls the operation of the various image forming units, the supplemental developer supply device 46 and the operation panel 103. The control unit 15 also includes a central processing unit (CPU) 16, a read-only memory (ROM) 18 which is a read-only memory in which a program and/or various kinds of data used by the CPU 16 are stored, a random access memory (RAM) 132 which is a readable and writable memory and is used as a work area used in data processing, and the like. The CPU 16, which may include one or more processors and one or more memories, is connected to the operation panel 103 and may be used by a user to make various settings and input a command and also used to present information to the user.

The image forming unit Pa includes a charging roller 2*a*, an exposure device 3*a*, the development device 4*a*, a primary transfer roller 5*a*, and a cleaning device 6*a* which are all disposed around the photosensitive drum 1*a* as an example of a photosensitive member. On the photosensitive drum 1*a*, a photosensitive layer having the negative charge polarity is formed on the outer circumferential surface of an aluminum cylinder. The photosensitive drum 1*a* rotates in the direction of an arrow R1 at a process speed of 300 mm/second.

The charging roller 2*a* in contact with the photosensitive drum 1*a* is rotatably driven by the photosensitive drum 1*a*. When applied with an oscillating voltage composed of a DC voltage and an alternating-current (AC) voltage superimposed thereon from a power source D3, the charging roller 2*a* charges the surface of the photosensitive drum 1*a* to a uniform negative dark potential VD. The exposure device 3*a* deflects a laser beam via a rotating mirror to write an electrostatic latent image on the surface of the charged photosensitive drum 1*a*. The laser beam is ON-OFF modulated based on scanning line image data generated by rasterizing a yellow decomposition color image. Using a two-component developer, the development device 4*a* applies toner to the electrostatic latent image (exposure portion) on the photosensitive drum 1*a* to perform reversal development on the toner image (described below).

The primary transfer roller 5*a* presses the inner circumferential surface of the intermediate transfer belt 24 to form a primary transfer portion Ta between the photosensitive drum 1*a* and the intermediate transfer belt 24 as an intermediate transfer member. When the primary transfer roller 5*a* is applied with a positive DC voltage from a power source D1, the toner image borne by the photosensitive drum 1*a* is primarily transferred onto the intermediate transfer belt 24 passing through the primary transfer portion Ta. The cleaning device 6*a* rubs the photosensitive drum 1*a* by using a cleaning blade to collect transfer residual toner that has not been transferred onto the intermediate transfer belt 24 and has remained on the photosensitive drum 1*a*.

<Development Device>

Figure 3:
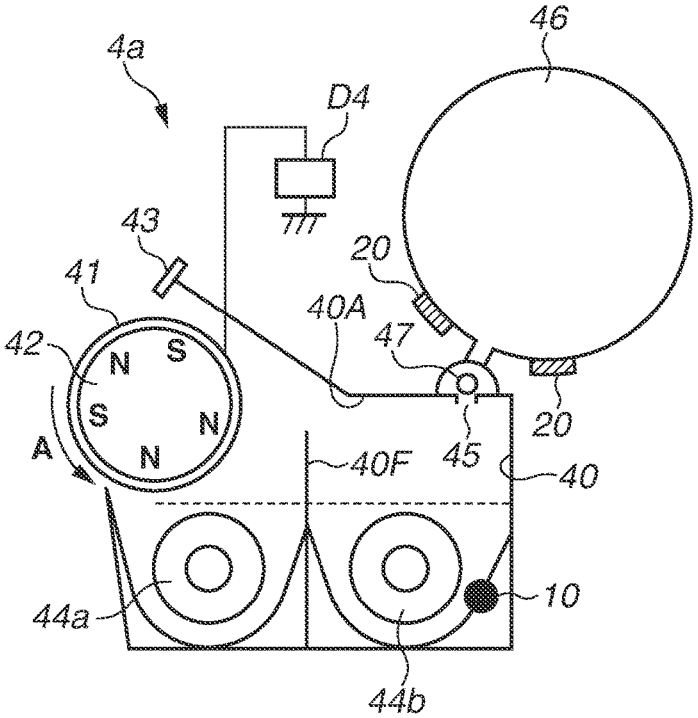
FIG. 3 illustrates a configuration of a development device.

FIG. 3 illustrates a configuration of the development device 4*a*. As illustrated in FIG. 3, the development device 4*a* bears a developer on a development sleeve 41, as an example of a developer bearing member, and develops the electrostatic latent image on the photosensitive drum 1*a*

(photosensitive member). In a development container 40, a pair of conveyance stirring screw 44*a* and 44*b* stirs the developer to charge the developer to allow it to be borne by the development sleeve 41. A developer cartridge 46, as an example of a feeding device, supplies the supplemental developer containing toner to the development container 40. A toner density sensor 10, as an example of a detection unit, detects the developer circulating in the development container 40 and outputs a signal corresponding to the ratio of the toner in the developer.

The development container 40 stores the developer mainly including a toner and a carrier. The ratio in weight of the toner in the developer (toner density (TD) ratio) in the initial state is 8%. However, the TD ratio is not limited to 8% since the TD ratio should be suitably adjusted depending on the toner charge amount, the carrier particle diameter, and the structure of the development device 4*a*.

The development device 4*a* is provided with an opening as a development region facing the photosensitive drum 1*a*. The development sleeve 41 made of a non-magnetic material is rotatably disposed while being partly exposed from the opening. A magnet 42 as a magnetic field generator is formed of a fixed cylindrical magnet having a plurality of magnetic poles in a predetermined pattern along the circumference of the development sleeve 41. The carrier attracting the toner on the surface thereof through the frictional charge is held on the development sleeve 41 by a magnetic field generated by the magnet 42.

In the development operation, the development sleeve 41 rotates in the direction of an arrow A while holding and bearing in layers the developer in the development container 40 to convey and supply the developer to the development region facing the photosensitive drum 1*a*. The thickness of the developer layer borne by the development sleeve 41 is regulated by a regulation member 43 disposed to closely face the development sleeve 41.

A power source D4 applies an oscillating voltage composed of a negative DC voltage Vdc and an AC voltage superimposed thereon to the development sleeve 41. The development sleeve 41 applied with the negative DC voltage Vdc becomes more negative relatively to the electrostatic latent image (exposure portion) formed on the photosensitive drum 1*a*, and negatively charged toner in the developer transfers from the development sleeve 41 to the photosensitive drum 1*a*. The developer that has remained on the development sleeve 41 after the development of the electrostatic latent image is collected in the development container 40 with the rotation of the development sleeve 41, and is mixed with the conveyed developer by the conveyance stirring screw 44*a*.

In the development container 40, the conveyance stirring screws 44*a* and 44*b*, as examples of stirring conveyance members for stirring and conveying the developer, are disposed in parallel with the development sleeve 41. The development sleeve 41 and the conveyance stirring screws 44*a* and 44*b* are connected by a gear mechanism (not illustrated) disposed outside the development container 40 and are integrally rotatably driven by a common drive motor.

The space in the development container 40 is divided into two spaces by a partition wall 40F. The conveyance stirring screw 44*a* is disposed in the space on the side of the development sleeve 41, and the conveyance stirring screw 44*b* is disposed in the space on the side of the developer cartridge 46. At both ends of the partition wall 40F in the longitudinal direction, openings (not illustrated) are formed to transfer the developer between the two spaces to circulate the developer in the development container 40.

The conveyance stirring screw 44*a* supplies the developer to the development sleeve 41 while conveying the developer from the back side to the front side of the diagram illustrated in FIG. 3. Conversely, the conveyance stirring screw 44*b* mixes the supplemental developer supplied from the developer cartridge 46 with the circulating developer while conveying the developer from the front side to the back side of the diagram illustrated in FIG. 3. The conveyance stirring screws 44*a* and 44*b* circulate the developer in the development container 40 and, at the same time, stir the toner and carrier to electrify them by friction.

<Two-Component Developer>

A toner as a two-component developer includes coloring resin particles containing a binding resin, colorant, and other additive agents as needed, and coloring particles to which an external additive agent, such as colloidal silica fine powder, is externally added. The toner is a negatively chargeable polyester resin manufactured through the grinding method. The desirable volume-average particle diameter is 4 to 8 μm inclusive. In the present exemplary embodiment, a toner having volume-average particle diameter of 5.5 μm was used.

The volume-average particle diameter of the toner was measured by using the Coulter Counter Model TA II (from Coulter).

A one-percent NaCl solution prepared by using first-class sodium chloride was used as an electrolytic aqueous solution for measurement samples. A surface-active agent, desirably 0.1 ml of alkyl benzene sulfonate, was added as a dispersant, and 0.5 to 50 mg of a measurement sample was added to 100 to 150 ml of an electrolytic aqueous solution. The electrolytic aqueous solution with a suspended measurement sample underwent dispersion processing for about 1 to 3 minutes by using an ultrasonic disperser, and then set in the Coulter Counter Model TA II. With the Coulter Counter Model TA II, the granularity distribution of 2 to 40-μm particles was measured by using a 100-μm aperture to obtain the volume-average distribution. The volume-average particle diameter was obtained from the volume-average distribution obtained in this way.

As the carrier, metals (surface oxidized or unoxidized iron, nickel, cobalt, manganese, chromium, rare earth, etc.), alloys of these metals, or magnetic particles, such as oxide ferrite are usable, the manufacturing process of magnetic particles is not particularly limited. The carrier has a volume-average particle diameter of 20 to 50 μm, desirably 30 to 40 μm, and a resistivity of $1\times10^7$ ohm-centimeters (Ωcm) or higher, desirably $1\times10^8$ ohm-centimeters (Ωcm) or higher. According to the present exemplary embodiment, the carrier has a volume-average particle diameter of φ40 μm and a resistivity of $5\times10^8$ ohm-centimeters (Ωcm).

The volume-average particle diameter of the carrier was measured by logarithmically dividing a particle diameter range from 0.5 to 350 μm by 32 in volume base, by using the laser diffraction type granularity distribution measuring device HEROS (from JEOL). Then, based on the result of counting the number of particles in each channel, the median diameter for the 50% volume was considered as the volume-average particle diameter.

For the measurement of the resistivity of the carrier, a sandwich type cell having a measurement electrode area of 4 $cm^2$ and an electrode distance of 0.4 cm was used. The resistivity of the carrier was measured based on the current that flowed in the circuit by applying an application voltage E (V/cm) between both the electrodes of the cell under the pressure of a 1 kg weight.

Further, as a low specific gravity carrier, a resin carrier manufactured by mixing a phenolic binder resin with a magnetic metal oxide and a non-magnetic metal oxide with a predetermined ratio through the polymerization method can be used. Such a resin carrier has a volume-average particle diameter of 35 μm, a true density of 3.6 to 3.7 ($g/cm^3$), and a magnetization level of 53 ($A \cdot m^2/kg$). For the magnetization level ($A \cdot m^2/kg$) of the magnetic carrier, the magnetic characteristics of the carrier were measured by using the vibration magnetic field type magnetic characteristics automatic recording device from Riken Denshi. More specifically, the magnetic characteristics were obtained by measuring the magnetization intensity of the cylindrically packed carrier placed in an external magnetic field with a magnetic field intensity of 79.6 kA/m (1000 oersted).

Employing the two-component development method has such advantages that image quality is stabilized and the device durability is maintained, compared to the cases of other development methods. On the other hand, when the toner is consumed, the mixture ratio (toner density ratio, i.e., TD ratio) of the non-magnetic toner to the carrier in the development container changes. As a result, there arises an issue that, when the toner charge amount (triboelectricity) changes, the development characteristics change and the output image density varies.

Therefore, there has been in practical use a toner replenishment control technique for correctly detecting the TD ratio of a developer and image density and replenishing an amount of toner which is neither excessive nor insufficient to maintain a constant image density of a formed image.

<Replenishment Control>

Employing the two-component development method has such advantages that image quality is stabilized and devices has durability, compared to the cases of other development methods. On the other hand, when the toner is consumed, the mixture ratio (toner density ratio, i.e., TD ratio) of the non-magnetic toner to the carrier in the development container changes. As a result, there arises an issue that, when the toner charge amount changes, the development characteristics change and the output image density varies. Therefore, there has been in practical use a toner replenishment control technique for correctly detecting the TD ratio of a developer and image density and replenishing an amount of toner which is neither excessive nor insufficient to maintain a constant image density of a formed image.

Figure 4:
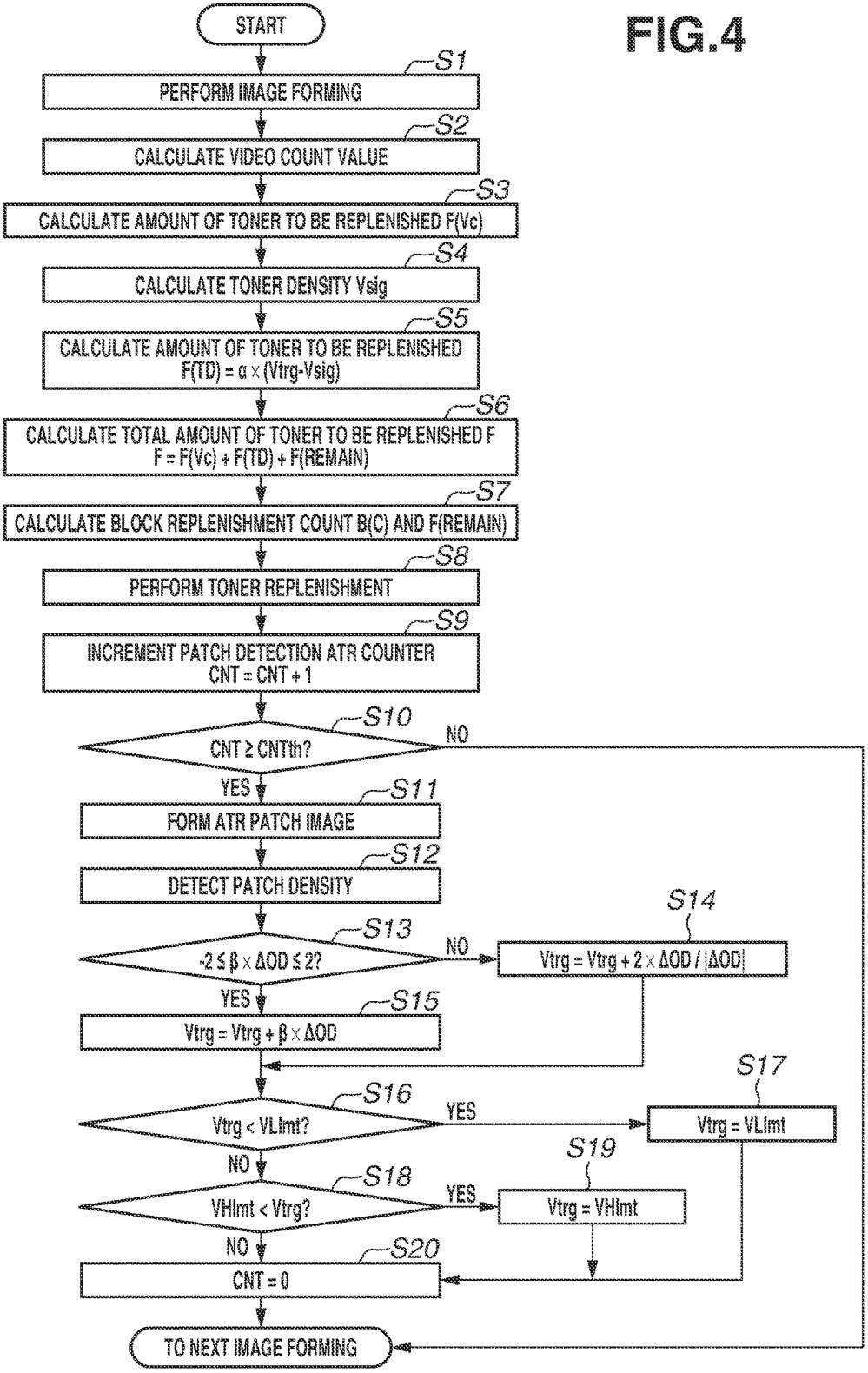
FIG. 4 is a flowchart illustrating a first comparative example as conventional control.
Figure 5:
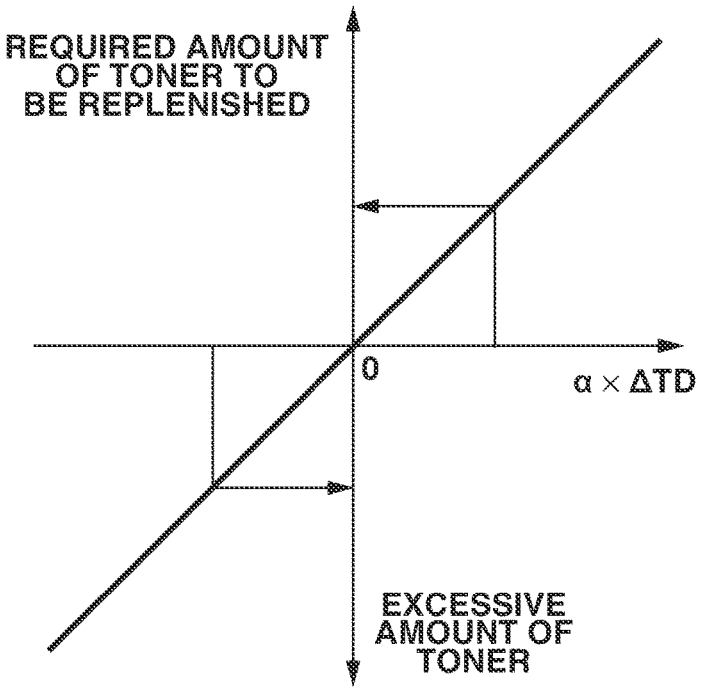
FIG. 5 illustrates a conversion table for conversion between the difference in the toner density (TD) ratio and the amount of toner to be replenished.
Figure 6:
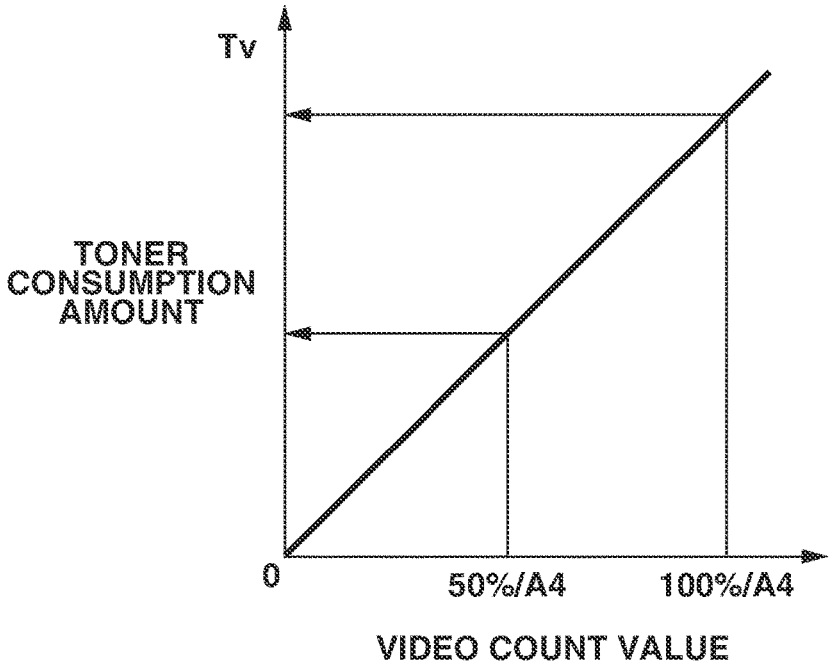
FIG. 6 illustrates a conversion table for conversion between the video count value and the toner consumption amount.
Figure 9:
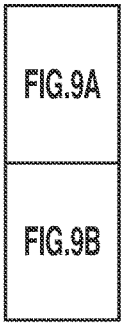
FIG. 9, composed of FIGS. 9A and 9B, is a flowchart illustrating a first exemplary embodiment.
Figure 9A:
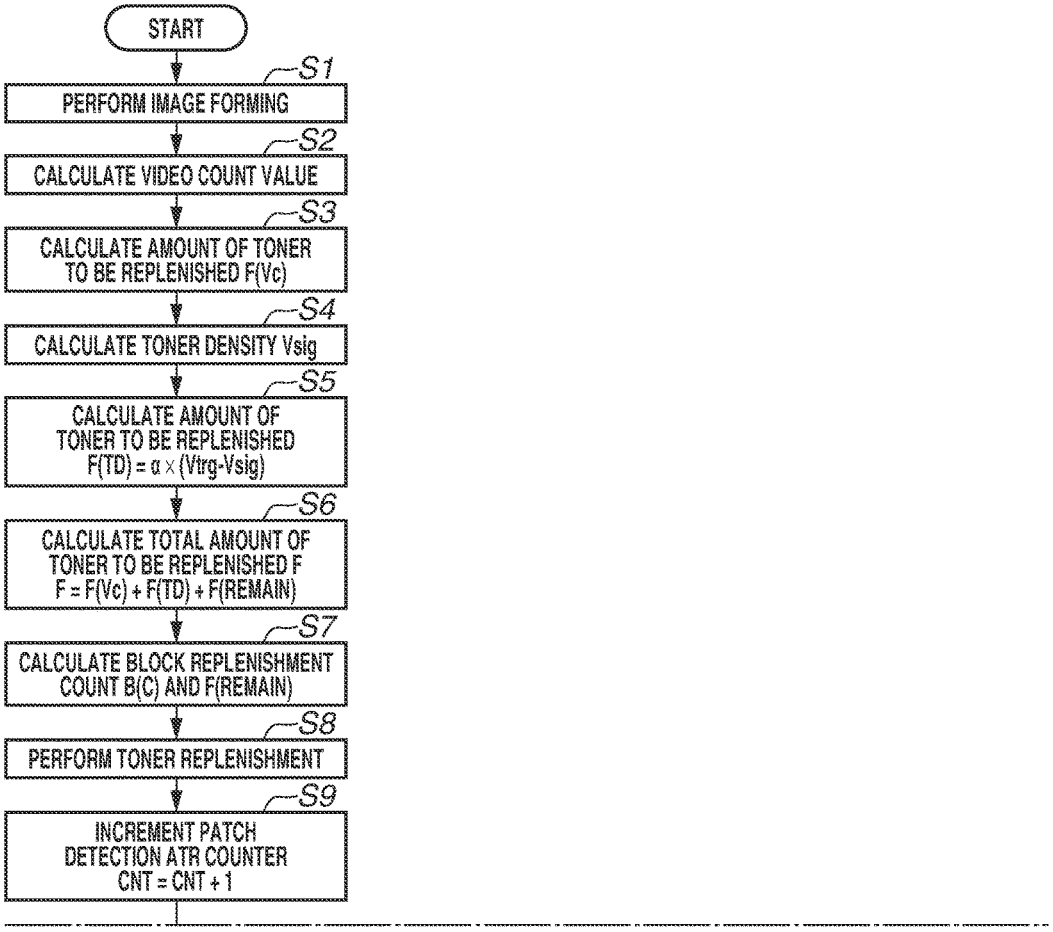
Figure 9B:
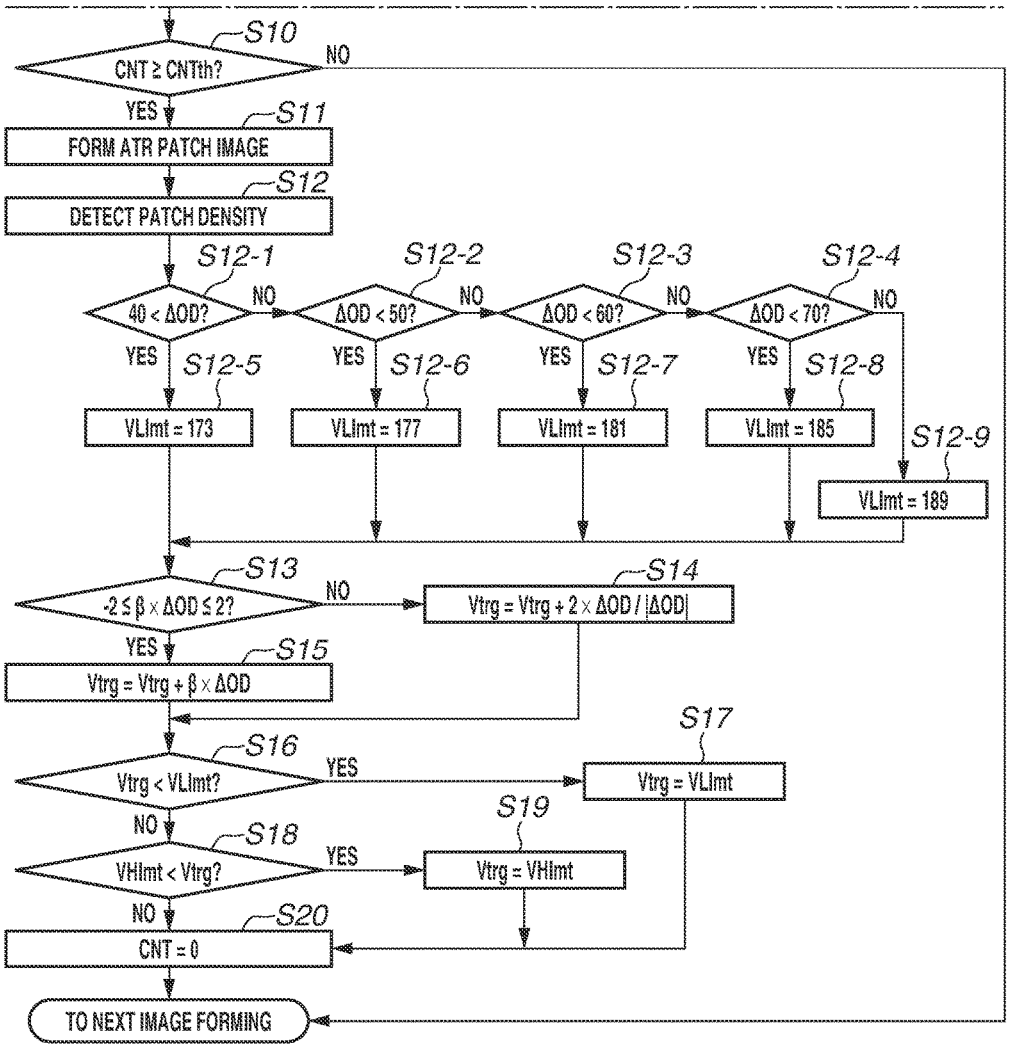

FIG. 4 is a flowchart illustrating conventional control as a first comparative example. FIG. 9 is a flowchart illustrating control according to the first exemplary embodiment. FIG. 5 illustrates a conversion table for conversion between the difference in TD ratio and the desired amount of toner to be replenished. FIG. 6 illustrates a conversion table for conversion between the video count value and the toner consumption amount.

The image forming apparatus 100 illustrated in FIG. 1 employs a triple control type replenishment control based on video counting, patch detection ATR control, and a toner density sensor. Patch detection ATR control refers to control for changing the toner density of the developer (two-component developer) by supplying the supplemental developer to the development container so that the toner application amount of the patch image formed on the image bearing member or the intermediate transfer member under predetermined charge/exposure conditions converges to a predetermined value. According to the present exemplary embodiment, an image density sensor 7*a* as an image density detection unit for detecting a patch image as illustrated in FIG. 2 detects the patch image formed on the photosensitive drum 1*a*. Alternatively, the detection of image density may be performed on a patch image on the intermediate transfer belt as an intermediate transfer member.

More specifically, the image density detection unit detects the patch image density detected in patch detection ATR control, and changes the target TD ratio in the development device based on a result of the detection. Then, the image density detection unit calculates the amount of supplemental developer to be replenished so that the TD ratio (mixture ratio of the toner to the carrier) in the development device measured by using the toner density sensor 10 becomes the changed target TD ratio. Then, the image density detection unit adds the toner consumption amount predicted from the video count value to the calculated amount of supplemental developer to be replenished to calculate the actual amount of supplemental developer to be replenished.

As illustrated in FIG. 3, all of the yellow, magenta, cyan, and black developer cartridges 46 have an approximately cylindrical shape, and are easily detachably attached to the image forming apparatus 100 via mounting members 20.

An upper wall 40A of the development container 40 in the vicinity of the conveyance stirring screw 44*b* of the development device 4*a* is provided with a developer replenishment opening 45. The developer replenishment opening 45 is provided with a developer replenishment screw 47 for conveying the supplemental developer. In the development device 4*a*, the supplemental developer of the amount equivalent to the toner amount consumed by image forming is supplied from the developer cartridge 46 to the development container 40 via the developer replenishment opening 45 by the rotary force and gravity of the developer replenishment screw 47. A known block replenishing method is employed as a replenishing method. The block replenishing method refers to control for accumulating toner up to a preset one-block toner replenishment amount (200 mg according to the present exemplary embodiment) and, each time the one-block toner replenishment amount reaches 200 mg, replenishing toner by rotating the developer replenishment screw 47 one round. Since the amount of toner to be replenished fluctuates within one cycle by a phase of the screw of the developer replenishment screw 47, the block replenishing method for constantly replenishing toner for each cycle is desirable to obtain a stable amount of toner to be replenished. According to present exemplary embodiment, a block replenishment count of 2 is set for the A4 size, and a block replenishment count of 4 is set for the A3 size. These block replenishment counts are set as the maximum replenishment block counts for one image of respective sizes.

As illustrated in FIG. 2, both conventional control (control according to the first comparative example) and control according to the present exemplary embodiment employ a method for combining the following three different control units in toner supply control. The output image density can be thus stabilized by combining the first, the second, and the third control units.

First control unit: this control unit performs toner density control in which the amount of toner to be replenished is set to maintain a constant TD ratio to be detected by the toner density sensor 10. As the toner density sensor 10, an inductance detection sensor for detecting change in the apparent magnetic permeability in the developer which decreases with increasing TD ratio and calculating the TD ratio was employed. The output of the toner density sensor 10 decreases with increasing TD ratio and relatively decreasing amount of carrier, and increases with decreasing TD ratio and relatively increasing amount of carrier. The first control unit detects the TD ratio of the developer in the development container 40 by the toner density sensor 10, compares the density signal of the toner density sensor 10 with the target TD ratio (a pre-stored toner density reference signal value in the initial state), and performs TD ratio detection replenishment control based on a result of the comparison.

Second control unit: this control unit performs toner charge amount control in which the amount of toner to be replenished is set to maintain a constant patch image to be detected by the image density sensor 7*a*. The image density sensor 7*a* as an image density detection unit detects a halftone patch image formed on the photosensitive drum 1*a* under predetermined image forming conditions, and outputs a density signal according to the toner application amount. Then, the second control unit compares the density signal with a pre-stored patch density initial reference signal and changes the target TD ratio of the developer in the development device 4*a* based on the comparison result. Based on the output of the toner density sensor 10, the second control unit controls the developer cartridge 46 (feeding device) so that the ratio of the toner in the developer converges to the target TD ratio. The image density sensor 7*a* is a regular reflection type optical sensor disposed to face the photosensitive drum 1*a* and configured to irradiate the surface of the photosensitive drum 1*a* with LED light and detect regular reflection light from the surface of the photosensitive drum 1*a*. Since increasing amount of toner particles on the surface of the photosensitive drum 1*a* increases the amount of scattered reflection light and decreases the amount of regular reflection light, an output signal according to the toner application amount of the patch image is obtained.

Third control unit: this control unit performs toner consumption amount replenishment control in which the amount of toner to be replenished is set to meet the toner consumption amount for each image detected by a video count processing circuit 11. The third control unit performs video count detection replenishment control in which the video count processing circuit 11 processes an exposure signal (or a density signal of an image information signal) of the image currently being formed to obtain the toner consumption amount for each image.

In step S1, a control unit 15 of the printer starts image forming. In step S2, the video count processing circuit 11 calculates the video count value of the image currently being formed. The video count value is the number of H levels of the output signal of a pulse width modulation circuit 13 which has performed pulse width modulation on the output of an image signal processing circuit 12. The video count value is counted for each pixel. The video count value N corresponding to the number of development dots for each document sheet can be calculated by integrating the count value for the entire document paper size. Further, the printing ratio can be obtained based on the video count value N. According to the present conventional example, the video count value N was set to 512 for the overall solid image (image with a 100% printing ratio) on one side of the A4 size paper for a color. For example, when the video count value N is 26, the printing ratio was calculated to 5% through ratio calculation.

In step S3, the control unit 15 calculates the toner consumption amount, i.e., the amount of toner to be replenished F (Vc) (hereinafter referred to as the video count control replenishment amount) referring to the conversion table illustrated in FIG. 6 with the calculated video count value N. The conversion table illustrated in FIG. 6 is a video count-replenishment amount conversion table in which the horizontal axis denotes video count value N for each document sheet and the vertical axis denotes the amount of toner to be replenished F (Vc). In step S4, the control unit 15 detects a density signal Vsig of the TD ratio of the developer using the toner density sensor 10 included in the development device 4*a*.

In step S5, the control unit 15 compares the target TD ratio Vtrg already obtained and recorded in memory with the density signal Vsig to obtain a difference (ΔTD) between Vtrg and Vsig. For more detail, when ΔTD=Vtrg−Vsig<0, the control unit 15 determines that the actual TD ratio is lower than the target TD ratio and calculates the amount of toner to be replenished F(TD) (hereinafter referred to as a toner density control replenishment amount) referring to the conversion table illustrated in FIG. 5 with ΔTD. Meanwhile, when ΔTD=Vtrg−Vsig≥0, the control unit 15 determines that the actual TD ratio is higher than the target TD ratio and calculates the amount of toner to be replenished F(TD) referring to the conversion table illustrated in FIG. 5 with ΔTD. In the conversion table illustrated in FIG. 5, the horizontal axis denotes the product of the difference ΔTD of the actual signal value and the TD ratio sensitivity adjustment coefficient α, and the vertical axis denotes the amount of toner to be replenished in the positive direction and the excessive amount of toner in the negative direction. Therefore, when ΔTD>0, the control unit 15 calculates the amount of toner to be replenished F(TD) as a negative value.

$$F(\mathrm{TD})=\alpha\times\Delta\mathrm{TD}=\alpha\times(V\mathrm{trg}-V\mathrm{sig})$$

Figure 7:
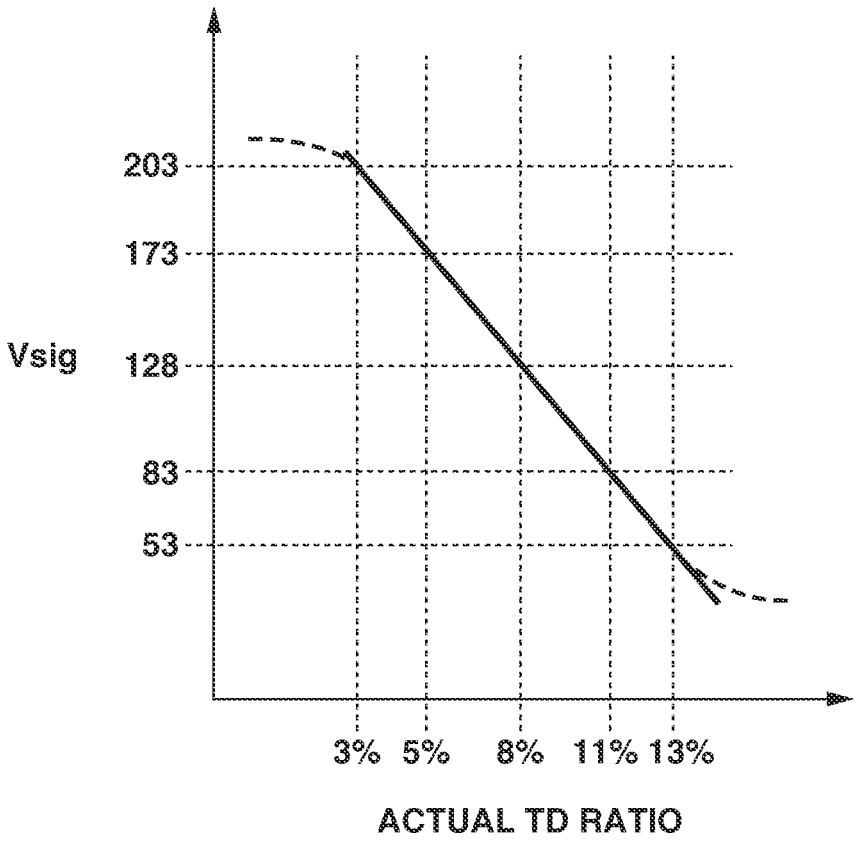
FIG. 7 illustrates a relation between the actual TD ratio and the inductance sensor detection value.

An inductance sensor as a toner density detection unit (toner density sensor) outputs a 6.8V analog signal with a value 0 to 255 in digital form. When the development device is initially installed, the control voltage is adjusted so that the toner density signal Vsig detected with a toner density of 8% becomes 128. The inductance sensor is an magnetic permeability sensor for outputting a signal corresponding to the toner density based on the phenomenon that an increase in the ratio of the carrier to the developer increases the magnetic permeability of the developer (two-component developer). When the above-described adjustment is performed, a relation between the actual toner density and the toner density signal Vsig detected by the inductance sensor as illustrated in FIG. 7 is satisfied. Within the TD ratio range from 3 to 13%, a linear relation is maintained between the TD ratio and the Vsig value, i.e., the Vsig value decreases by 15 for each 1% increase in the TD ratio. In other ranges of the TD ratio, the sensitivity on the Vsig value is lowered (dashed lines illustrated in FIG. 7).

In step S6, the control unit 15 determines the actual amount of toner to be replenished F based on the following formula.

F (REMAIN) is the remainder of the previous replenishment control (described below).

$$F=F(\mathrm{TD})+F(Vc)+F(\mathrm{REMAIN})$$

In step S7, the control unit 15 divides the above-described amount of toner to be replenished F by the one-block replenishment amount to obtain the block replenishment count B(C).

$$B(C)=\text{Integer part of } F/\text{one-block replenishment amount (200 mg)},\text{Remainder of replenishment: } F(\mathrm{REMAIN})$$

In step S8, when B(C)>1, the control unit 15 performs replenishment control for the integer part of the block replenishment count B(C). In this case, the replenishment amount smaller than the one-block replenishment amount is carried over to the next replenishment timing as F(REMAIN).

In the case of the first comparative example, each time the number of printed sheets reaches 200 in A4 image lateral feed (YES in step S10), the processing proceeds to step S11. In step S11, the control unit 15 forms the above-described patch image. In other timing (NO in step S10), the control unit 15 continues image forming. CNT illustrated in FIG. 4 indicates a counter for patch detection ATR control which increments for every page in A4 image lateral feed in step S9. CNTth indicates a threshold value for patch detection execution used to determine whether to execute patch detection ATR control. In step S10, CNTth is set to 200 according to the present exemplary embodiment.

In step S11, in patch detection ATR control, the control unit 15 forms an electrostatic latent image of the reference toner image (patch image) having a fixed area on the photosensitive drum 1*a* and develops the electrostatic latent image with a predetermined development contrast voltage. In step S12, the control unit 15 detects the patch image using the image density sensor 7*a* as an image density detection unit and acquires a density signal SigD.

Then, the control unit 15 compares the obtained density signal SigD with the patch density initial reference signal SigDref pre-stored in memory, and calculates and sets the target TD ratio Vtrg. The processing will be described in detail below.

When a difference ΔOD=SigD−SigDref≥0, since the density of the patch image is determined to be low, the image density needs to be increased by upwardly correcting the target TD ratio. In step S15, the control unit 15 calculates the target TD ratio (Vtrg) to return to the initial density based on the difference ΔOD by using the following formula. In the following formula, the control unit 15 corrects the target TD ratio (Vtrg) by multiplying the actual signal value (SigD−SigDref) by the TD ratio sensitivity adjustment coefficient β. The TD ratio sensitivity adjustment coefficient β should be set in consideration of the sensitivity of the patch detection sensor or the inductance sensor per 1% of the actual TD ratio. According to both the first comparative example and the first exemplary embodiment, β is set to 0.075.

$$Vtrg=Vtrg+\beta\times\Delta OD$$

Meanwhile, when the difference ΔOD=SigD−SigDref<0, since the density of the patch image is determined to be high, the image density needs to be decreased by downwardly correcting the target TD ratio. In step S15, the control unit 15 calculates the target TD ratio (Vtrg) to return to the initial density based on the difference ΔOD by using the following formula.

$$Vtrg=Vtrg+\beta\times\Delta OD$$

The maximum variation range of the target TD ratio in one patch detection ATR control is set to ±2 in step S14, according to the first comparative example and the first exemplary embodiment. This setting is intended to prevent the TD ratio from being excessively affected by variation in patch detection ATR.

According to the first comparative example and the first exemplary embodiment, an upper limit value and a lower limit value of Vtrg are set to prevent the target TD ratio Vtrg obtained through patch detection ATR control from being out of the tolerance of the TD ratio permissible as a system (as described above, Vtrg needs to be set in view of a range in which the inductance sensor is able to linearly detect the toner density with sufficient sensitivity). According to present exemplary embodiment, when the control unit 15 determines that the target TD ratio Vtrg is below "the lower limit TD ratio (VLlmt) permissible as a system" pre-stored in memory (YES in step S16), the processing proceeds to step S17. In step S17, the control unit 15 sets Vtrg=VLlmt. In this case, the control unit 15 calculates the lower limit TD ratio (VLlmt) based on the limit of image failures (a white spot image caused by carrier adhesion in the present exemplary embodiment) occurring with a low TD ratio. More specifically, the lower limit TD ratio was set to 5% while the initial TD ratio was set to 8%. Meanwhile, when the control unit 15 determines that the target TD ratio Vtrg exceeds "the upper limit TD ratio (VHlmt) permissible as a system" pre-stored in memory (YES in step S18), the processing proceeds to step S19. In step S19, the control unit 15 sets Vtrg=VHlmt. In this case, the control unit 15 calculates the upper limit TD ratio (VHlmt) based on the limit of image failures (what is called fogging with which toner is developed in the blank portion in the present exemplary embodiment) occurring with a high TD ratio. More specifically, the upper limit TD ratio was set to 11% while the initial TD ratio was set to 8%. More specifically, referring to FIG. 7, the lower limit TD ratio 5%=173 and the upper limit TD ratio 11%=83, Vtrg may range from 83 to 173 (83≤Vtrg≤173, i.e., VLlmt=173 and VHlmt=83).

As described above, the first comparative example employs replenishment control based on a triple control method including video counting, patch detection ATR control, and a toner density sensor to enable the output image density to be stabilized with a sufficient balance.

Figure 8A:
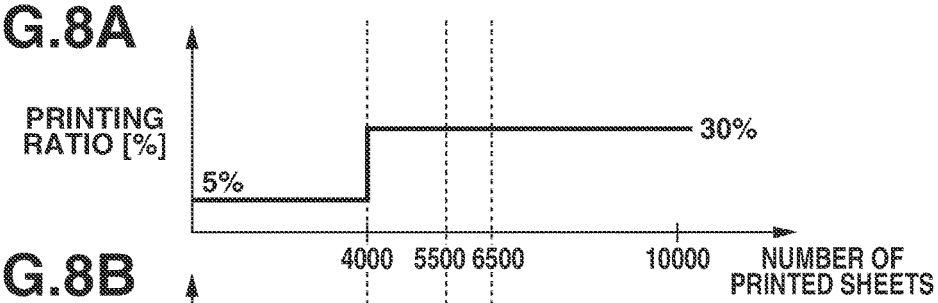
FIG. 8A illustrates a transition of the printing ratio.
Figure 8B:
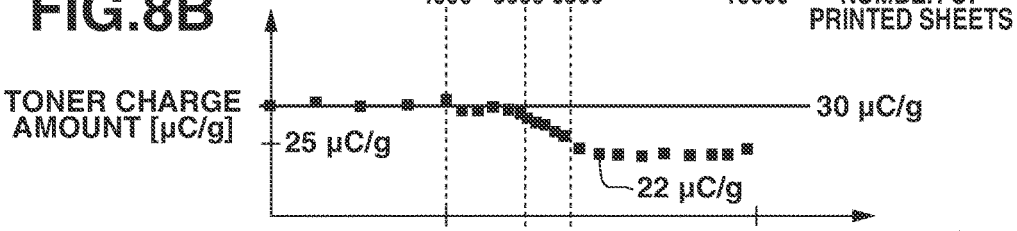
FIG. 8B illustrates a transition of the toner charge amount.
Figure 8C:
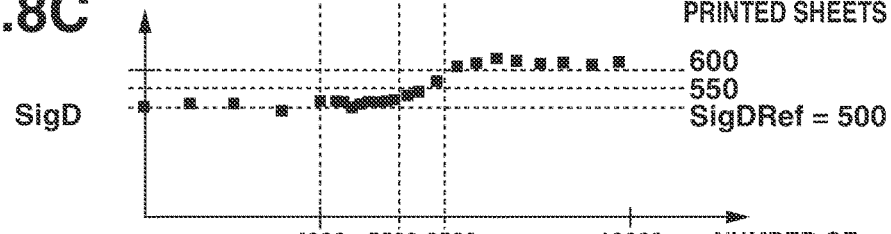
FIG. 8C illustrates a patch image density signal SigD.
Figure 8D:
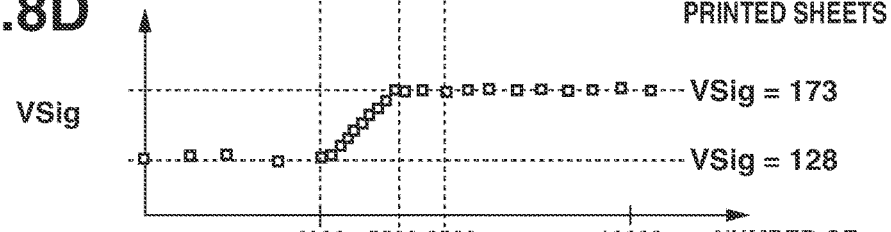
FIG. 8D illustrates a toner density signal Vsig.
Figure 8E:
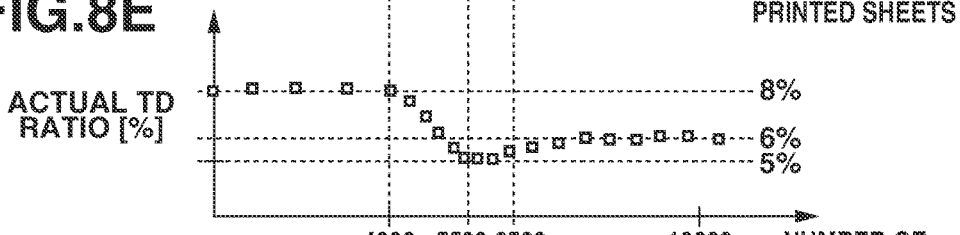
FIG. 8E illustrates the actual TD ratio.
Figure 8F:
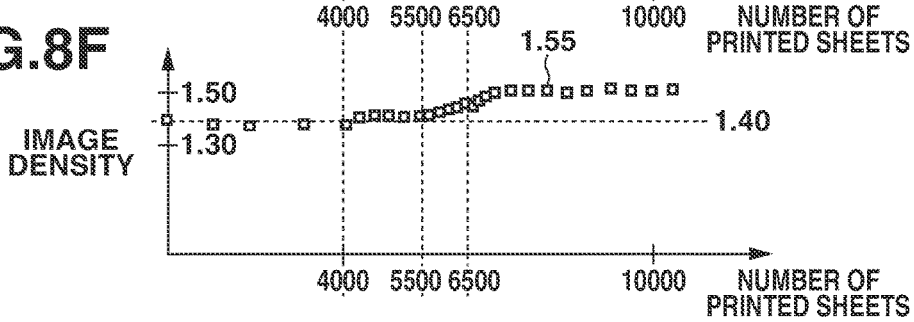
FIG. 8F illustrates the image density, when 4000 sheets are printed with a 5% printing ratio image and then 6000 sheets are printed with a 30% printing ratio in control according to the first comparative example.

However, when high-printing ratio images described at the beginning of the present specification are continuously printed, the image stability degraded even if the above-described triple control method was performed in a certain case. FIG. 8A illustrates a transition of the printing ratio, FIG. 8B illustrates a transition of the toner charge amount, FIG. 8C illustrates a patch image density signal SigD, FIG. 8D illustrates a toner density signal Vsig, FIG. 8E illustrates the actual TD ratio (toner density ratio), and FIG. 8F illustrates the image density, when printing is performed with a 5% printing ratio from the beginning to 4000 sheets and then is performed with a 30% printing ratio to 10000 sheets in control according to the first comparative example.

Referring to FIGS. 8A, 8B, 8C, and 8D, after the printing ratio changes from 5% to 30% at the timing when the number of printed sheets reaches 4000, toner replenishment accompanying a large toner consumption amount is performed highly frequently and the stirring time is shortened. As a result, the toner charge amount is decreased and the patch image density SigD is increased. However, before the number of printed sheets reaches 5500, both the toner charge amount and the patch image density are stabilized by decrease in the TD ratio as a result of the patch detection ATR control. When the number of printed sheets reaches 5500, the TD ratio falls to the lower limit value (173) of the toner density signal Vsig (signal value for the TD ratio 5%), and the target TD ratio cannot be decreased further. When printing of images with a 30% printing ratio is subsequently continued, the toner charge amount moderately decreases since a unit for increasing the charge amount is no longer provided. As a result, both the patch image density SigD and the image density increase. Before the number of printed sheets reaches 6500, the relation between the toner density signal Vsig detected by the inductance sensor and the actual TD ratio of the developer illustrated in FIG. 7 is maintained. As understood from FIGS. 8D and 8E, there is no deviation in the relation between the toner density signal Vsig and the actual TD ratio (Vsig 173=Actual TD ratio 5%). However, as the number of printed sheets is increased, the toner charge amount continues decreasing and the difference ΔOD between the patch image density SigD and the patch density initial reference signal SigDref (ΔOD=SigD−SigDref) gradually increases. When the number of printed sheets exceeds 6500, increase in the bulk density of the developer due to decrease in the toner charge amount leads to erroneous detection by the inductance sensor as described above. The toner density signal Vsig starts to deviate from the actual toner density ratio (actual TD ratio) of the developer. In such a state, the detection value of the toner density signal Vsig outputs the TD ratio lower than the actual TD ratio. Therefore, after replenishment control is performed so that the toner density signal Vsig becomes 173 (TD ratio 5%), the actual TD ratio becomes higher than the target TD ratio 5%. Referring to FIG. 8E, before the number of printed sheets reaches 6500, the actual TD ratio of the developer can be controlled at 5%. However, when the number of printed sheets exceeds 6500, the actual TD ratio of the developer gradually increases and eventually reaches 6% while the toner density signal Vsig is 173. In a case where the actual TD ratio increases in this way, the decrease in the toner charge amount can no longer be restrained. More specifically, a 1% increase in the TD ratio accelerates the decrease in the toner charge amount. As a result of the accelerated decrease in the toner charge amount after the number of printed sheets reaches 6500, the toner charge amount becomes 22 μC/g, the patch image density SigD changes to about 600 and the image density changes to 1.55. According to the present exemplary embodiment, data points of, for example, the TD ratio for the number of printed sheets on the horizontal axis are plotted not for all of results of the patch detection ATR control for the convenience of notation, i.e., some data points are thinned out at appropriate intervals.

On the other hand, according to the first exemplary embodiment, even if the inductance sensor erroneously performs the detection due to the decrease in the toner charge amount occurs when the above-described high-printing ratio images are continuously printed, the lower limit VLlmt of the target TD ratio is offset for erroneous detection so that the actual TD ratio is set to the desired TD ratio 5%. The processing will be described in detail below.

Figure 10:
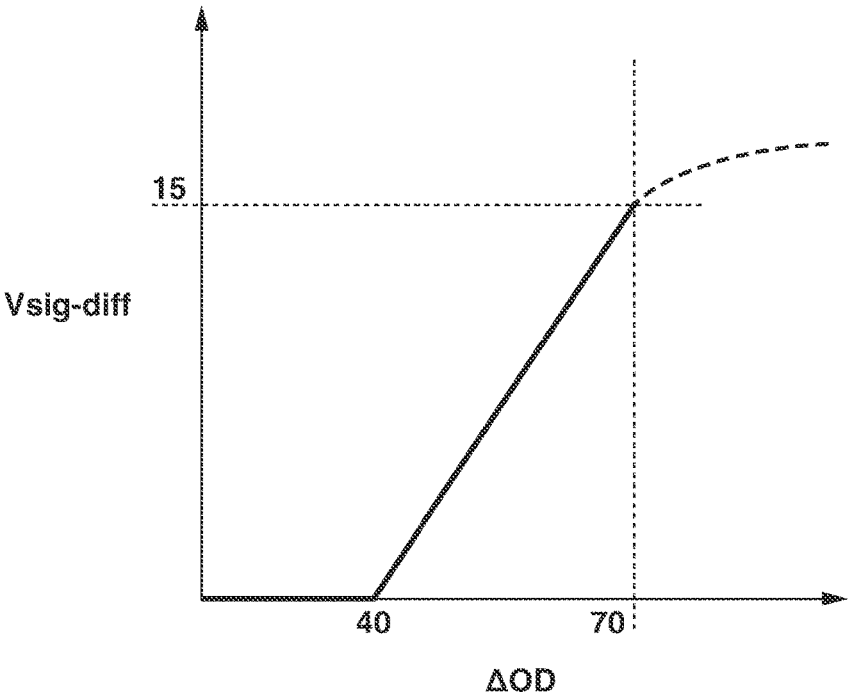
FIG. 10 illustrates a relation between ΔOD and Vsig-diff.

FIG. 9 is a flowchart illustrating the first exemplary embodiment. Referring to FIG. 9, steps S12-1 to S12-9 are newly added between steps S12 and S13 of the flowchart according to the first comparative example. After the patch density SigD is detected in step S12, the control unit 15 changes the lower limit value VLlim of the target TD ratio depending on the magnitude of the difference ΔOD between the patch density signal SigD and the patch density initial reference signal SigDref (ΔOD=SigD−SigDref). FIG. 10 illustrates the difference Vsig-diff of the toner density signal Vsig from the actual TD ratio when ΔOD changes. Referring to FIG. 10, erroneous detection by the inductance sensor occurs when ΔOD exceeds 40, and the amount of erroneous detection becomes moderate when ΔOD exceeds 70. Since ΔOD is the difference of the patch density signal SigD from the patch density initial reference signal SigDref, the control unit 15 can determine that the larger difference ΔOD causes a larger decrease in the toner charge amount. Estimating the magnitude of ΔOD enables the decreased amount of toner charge amount to be estimated and further enables the amount of erroneous detection by the inductance sensor to be estimated with reference to FIG. 10. Therefore, when the detection signal of the inductance sensor, i.e., the apparent TD ratio is below the desired lower limit value (5%), the actual TD ratio can be corrected to the desired lower limit value (5%) in such a manner that the lower limit value VLlim of the target TD ratio is offset to cancel the amount of erroneous detection.

According to the first exemplary embodiment, as illustrated in Table 1, the control unit 15 offsets the lower limit value VLlim of the target TD ratio according to the amount of erroneous detection by the inductance sensor based on the value of ΔOD, as illustrated in FIG. 10.

TABLE 1

| ΔOD | Target TD ratio lower limit VLlim |
|---|---|
| ΔOD < 40 | 173 |
| 40 ≤ ΔOD < 50 | 177 |
| 50 ≤ ΔOD < 60 | 181 |
| 60 ≤ ΔOD < 70 | 185 |
| 70 ≤ ΔOD | 189 |

According to the present exemplary embodiment, the amount of erroneous detection is about 1% (Vsig-diff=15) when ΔOD=70 and approximately constant for larger ΔOD. Therefore, as illustrated in Table 1, the lower limit value VLlim is changed in increments of 4 in a range of ΔOD from 40 to 70 in steps of 10.

Figure 11A:
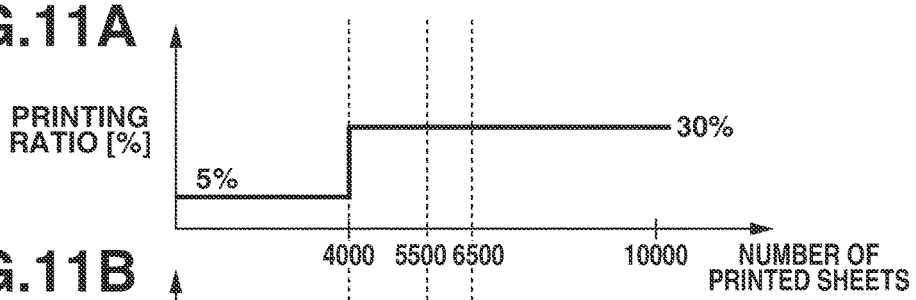
FIG. 11A illustrates a transition of the printing ratio.
Figure 11B:
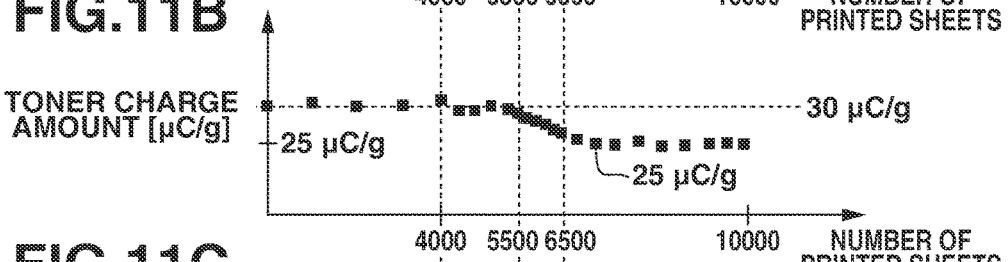
FIG. 11B illustrates a transition of the toner charge amount.
Figure 11C:
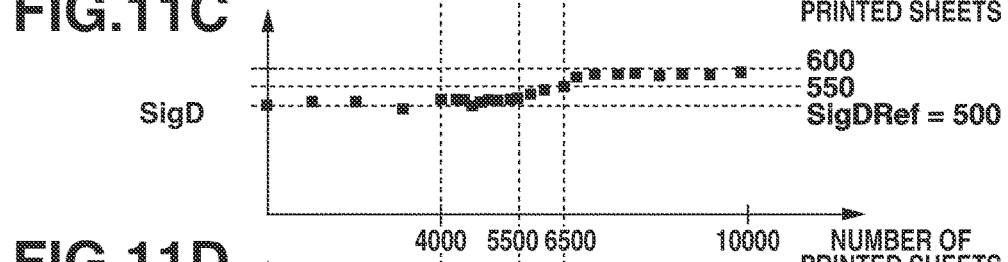
FIG. 11C illustrates a patch image density signal SigD.
Figure 11D:
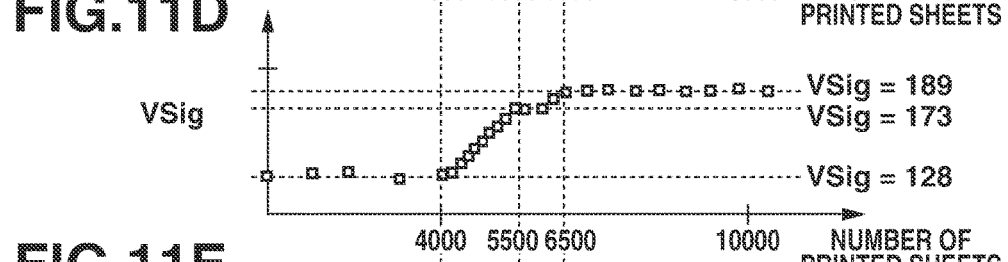
FIG. 11D illustrates a toner density signal Vsig.
Figure 11E:
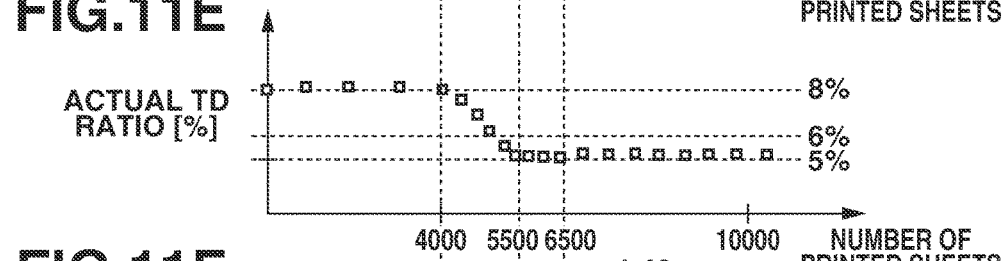
FIG. 11E illustrates the actual TD ratio.
Figure 11F:
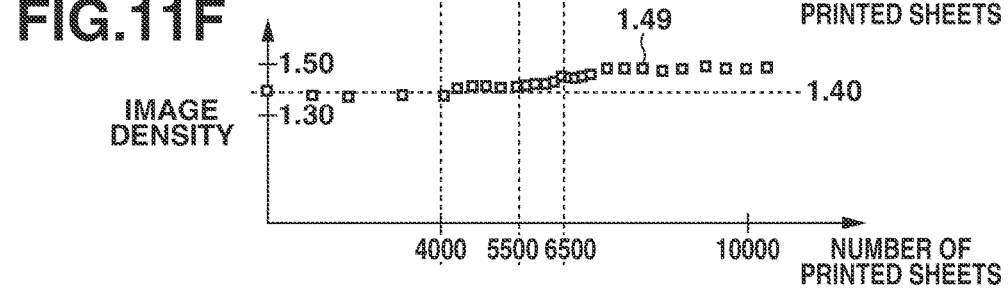
FIG. 11F illustrates the image density, when 4000 sheets are printed with a 5% printing ratio image and then 6000 sheets are printed with a 30% printing ratio image in control according to the first exemplary embodiment.

FIG. 11A illustrates a transition of the printing ratio, FIG. 11B illustrates a transition of the toner charge amount, FIG. 11C illustrates a patch image density signal SigD, FIG. 11D illustrates a toner density signal Vsig, FIG. 11E illustrates the actual TD ratio (toner density ratio), and FIG. 11F illustrates the image density, when printing is performed with a 5% printing ratio from the beginning to 4000 sheets and is performed with a 30% printing ratio to 10000 sheets in control according to the first exemplary embodiment, similar to the first comparative example. Similar to the case of the first comparative example, before the number of printed sheets reaches 5500, both the toner charge amount and the patch image density are stabilized by decrease in the TD ratio. After the number of printed sheets reaches 5500, according to the first comparative example, the TD ratio falls to the lower limit value and the toner charge amount decreases. Accordingly, erroneous detection by the inductance sensor occurs and leads to the further decrease in the toner charge amount. According to the present exemplary embodiment, however, the toner density signal Vsig is decreased by offsetting the lower limit value VLlim of the target TD ratio according to the relation illustrated in FIG. 10. This enables control to be performed in such a manner that the actual TD ratio is set to the desired lower limit (5%) even if erroneous detection by the inductance sensor occurs. Although the toner density signal Vsig is not immediately decreased by offsetting the lower limit value VLlim of the target TD ratio, the target TD ratio can be set to a value below the lower limit value VLlim, of the target TD ratio, set before offsetting the lower limit value VLlim, as a result of patch detection ATR control. As a result, the toner charge amount by erroneous detection by the inductance sensor does not further decrease. Accordingly, the toner charge amount is restrained at least to 25 [μC/g] and the image density is 1.49 at most, achieving image stability with higher accuracy when high-printing ratio images are continuously printed. According to the present exemplary embodiment, the upper limit value VHlim is not changed when offsetting the lower limit value VLlim.

According to the present exemplary embodiment, when the difference ΔOD between the patch image density SigD and the patch density initial reference signal SigDref (ΔOD=SigD−SigDref) becomes smaller than a predetermined value (when the difference becomes zero), the offset is canceled.

Even if erroneous detection by the inductance sensor occurs by variation in the toner charge amount, the toner density can be controlled to the desired range of the TD ratio by offsetting the target TD ratio so that the actual TD ratio is set to the desired value as in the present exemplary embodiment. Meanwhile, since patch detection ATR control largely depends on the state of the photosensitive drum and the surrounding environment, there may be a case where erroneous detection by the inductance sensor is erroneously detected. Assuming such a case, control according to the present exemplary embodiment may be performed, for example, according to the humidity around the development device, the average value of the printing ratio, and the amount of toner replenished to the developing device.

For example, the present exemplary embodiment may also be configured to start offsetting when a condition that the relative humidity within or around the development device is equal to or higher than a preset humidity is also satisfied. More specifically, the present exemplary embodiment may also be configured to start offsetting when the relative humidity is 25% or above. Similar effects can be obtained even if the present exemplary embodiment is configured to use the absolute humidity instead of the relative humidity.

The present exemplary embodiment may also be configured to start offsetting when a condition that the printing ratio (image printing ratio) is equal to or higher than a predetermined value, for example 15%, is satisfied in addition to the above-described condition.

The present exemplary embodiment may also be configured to start offsetting when a condition that the amount of toner replenished to the developing device has reached a preset value is satisfied.

<Description of Faraday Cage>

Figure 12:
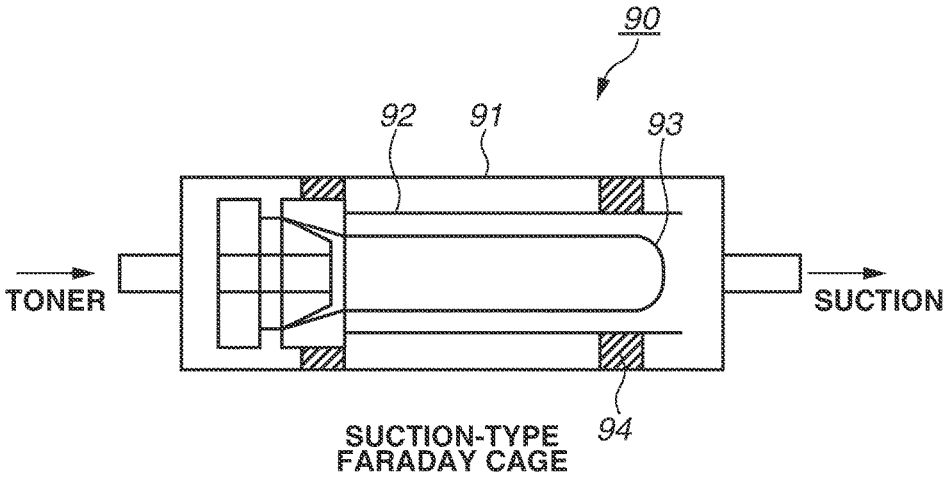
FIG. 12 illustrates a configuration of a Faraday cage.

FIG. 12 illustrates a configuration of a Faraday cage. The toner charge amount was measured using a Faraday cage, as illustrated in FIG. 12. The Faraday cage includes a double cylinder formed of coaxially disposed two metal cylinders having different axial diameters, and a toner collection paper filter 93 for supplying a toner in the inner cylinder of the double cylinder. An inner cylinder 92 and an outer cylinder 91 of the double cylinder are insulated by an insulating member 94. When charge particles having a charge amount q are put in the inner cylinder 92, electrostatic induction produces a state where a metal cylinder having an electric quantity q virtually exists. The charge amount induced by the double cylinder was measured by using KEITHLEY 616 DIGITAL ELECTROMETER, and the measured charge amount divided by the toner weight in the inner cylinder 92 is set as the toner charge amount Q/M. The charge amount is measured by DIGITAL ELECTROMETER, and the measured charge amount divided by the toner weight in the inner cylinder 92 is set as the toner charge amount Q/M.

In the first exemplary embodiment, the lower limit value VLlim of the target TD ratio is offset when the printing ratio of the output image is high.

Meanwhile, a second exemplary embodiment is configured to upwardly offset the upper limit value LHlim of the target TD ratio when the printing ratio of the output image is low. The reason for this will be described below.

When the printing ratio of the output image is low, if low-printing ratio images are continuously printed for a prolonged period of time, only a small amount of toner is replaced in the developing device. Accordingly, the frictional charge is excessively generated between the toner and the carrier, and the toner charge amount increases. In patch detection ATR control, a high toner density is set to decrease the toner charge amount. However, if the printing ratio is very low, the toner density overcomes this setting and remains set to the upper limit value. After that, the toner density can no longer be adjusted. Therefore, if low-printing ratio images are continuously printed, the toner charge amount increases and, at the same time, the bulk density of the developer decreases. Accordingly, the apparent magnetic permeability by the inductance sensor decreases. This decrease in the apparent magnetic permeability leads the inductance sensor to erroneously detect the decrease in the ratio of the carrier in the developer and to output a comparatively high toner density. The actual toner density therefore becomes lower than the desired toner density by the amount of erroneous detection even if the toner density is set to the upper limit value.

To solve this issue, the present disclosure is configured to upwardly offset the upper limit value of the target TD ratio. According to the present disclosure, the first and the second exemplary embodiments have the same configuration except that first exemplary embodiment offsets the lower limit value while the second exemplary embodiment offsets the upper limit value.

According to the present exemplary embodiment, after detection of the patch density SigD, the control unit 15 changes the upper limit value VHlim of the target TD ratio according to the magnitude of difference ΔOD between the patch density signal SigD and the patch density initial reference signal SigDref (ΔOD=SigD−SigDref), similar to the first exemplary embodiment.

According to the present exemplary embodiment, as illustrated in Table 2, the control unit 15 offsets the upper limit value VHlim of the target TD ratio according to the amount of erroneous detection by the inductance sensor based on the value of ΔOD, as illustrated in FIG. 10.

TABLE 2

| ΔOD | Target TD ratio upper limit VHlim |
|---|---|
| −40 < ΔOD | 125 |
| −50 < ΔOD ≤ −40 | 121 |
| −60 < ΔOD ≤ −50 | 117 |
| −70 < ΔOD ≤ −60 | 113 |
| ΔOD ≤ −70 | 109 |

According to present exemplary embodiment, erroneous detection by the inductance sensor occurs when ΔOD exceeds −40, and the amount of erroneous detection becomes moderate when ΔOD exceeds −70. Since ΔOD is the difference of the patch density signal SigD from the patch density initial reference signal SigDref, the control unit 15 can determine that the larger difference ΔOD causes a larger increase in the toner charge amount. Estimating the magnitude of ΔOD enables the increased amount of toner charge amount to be estimated and further enables the amount of erroneous detection by the inductance sensor to be estimated. Therefore, when the detection signal of the inductance sensor, i.e., the apparent TD ratio is above the desired upper limit value (9%), the actual TD ratio can be corrected to the desired upper limit value (9%) in such a manner that the upper limit value VHlim of the target TD ratio is offset to cancel the amount of erroneous detection. According to the second exemplary embodiment, as illustrated in Table 2, the control unit 15 offsets the upper limit value VHlim of the target TD ratio according to the amount of erroneous detection by the inductance sensor based on the value of ΔOD. According to the present exemplary embodiment, the amount of erroneous detection is about 1% (Vsig-diff=15) when ΔOD=−70 and approximately constant for larger ΔOD. Therefore, as illustrated in Table 2, the upper limit value VHlim is changed in increments of 4 in a range of ΔOD from −40 to −70 in steps of 10.

According to the present exemplary embodiment, however, the toner density signal Vsig is increased by offsetting the upper limit value VHlim of the target TD ratio. This enables control to be performed in such a manner that the actual TD ratio reaches the desired lower limit (9%) even if erroneous detection by the inductance sensor occurs. Although the toner density signal Vsig is not immediately increased by offsetting the upper limit value VHlim of the target TD ratio, the target TD ratio can be set to a value above the upper limit value LHlim of the target TD ratio, set before offsetting the upper limit value VHlim, as a result of patch detection ATR control. As a result, the control unit 15 is able to prevent a further increase in the toner charge amount by erroneous detection by the inductance sensor, and accordingly prevent extreme reduction of the image density. In the present exemplary embodiment, the lower limit value VLlim is not changed when the upper limit value VHlim is offset.

According to the present exemplary embodiment, when the difference ΔOD between the patch image density SigD and the patch density initial reference signal SigDref (ΔOD=SigD−SigDref) becomes larger than a predetermined value (when the difference becomes zero), the offset is canceled.

Even if erroneous detection by the inductance sensor occurs by variation in the toner charge amount, the toner density can be controlled to the desired range of the TD ratio by offsetting the target TD ratio so that the actual TD ratio is set to the desired value as in the present exemplary embodiment. Meanwhile, since patch detection ATR control largely depends on the state of the photosensitive drum and the surrounding environment, there may be a case where erroneous detection by the inductance sensor is erroneously detected. Assuming such a case, control according to the present exemplary embodiment may be performed, for example, according to the humidity around the development device, the average value of the printing ratio, and the amount of toner replenished to the developing device.

For example, the present exemplary embodiment may also be configured to start offsetting when a condition that the relative humidity within or around the development device is equal to or lower than a preset humidity is also satisfied. More specifically, the present exemplary embodiment may also be configured to start offsetting when the relative humidity is 5% or above. Similar effects can be obtained even if the present exemplary embodiment is configured to use the absolute humidity instead of the relative humidity.

The present exemplary embodiment may also be configured to start offsetting when a condition that the printing ratio (image printing ratio) is equal to or lower than a predetermined value, for example 2%, is satisfied in addition to the above-described condition.

The present exemplary embodiment may also be configured to start offsetting when a condition that the amount of toner replenished to the developing device has reached a preset value is satisfied.

As described above, according to the present exemplary embodiment, variation in an image can be reduced even if an extreme variation in the toner density occurs.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-138746, filed Jul. 13, 2016, which is hereby incorporated by reference herein in its entirety.

What is claimed is:

1. An image forming apparatus comprising:

an image forming unit that includes an image bearing member and a development device, the development device including a developer container and a developer bearing member, the developer container containing a developer including toner and carrier, the developer bearing member bearing the developer for developing an electrostatic latent image formed on the image bearing member;

a developer replenishment unit configured to replenish the developer container with the developer;

an image density sensor configured to detect a density of a patch image formed by the image forming unit;

an inductance sensor configured to detect a toner density of the developer contained in the developer container as a ratio of the toner to the carrier on a basis of a magnetic permeability of the developer contained in the developer container; and a controller, wherein the controller determines an amount of the developer supplied to the developer container by the developer replenishment unit on a basis of the toner density, detected by the inductance sensor, of the developer contained in the developer container and on a basis of a target toner density that is a target of the toner density of the developer contained in the developer container so that the toner density of the developer contained in the developer container becomes equal to the target toner density, wherein the controller sets the target toner density between an upper limit value and a lower limit value on a basis of the density of the patch image detected by the image density sensor and on a basis of a reference density of the patch image, wherein the controller sets the target toner density such that the target toner density set when the density of the patch image detected by the image density sensor is higher than the reference density of the patch image is lower than the target toner density set when the density of the patch image detected by the image density sensor is lower than the reference density of the patch image, wherein, in a case where the set target toner density is the lower limit value, the controller is able to execute a mode of changing the lower limit value of the target toner density, wherein, in the execution of the mode, the controller is configured to (i) set the lower limit value of the target toner density into a first lower limit value in a case where the density of the patch image detected by the image density sensor is higher than the reference density of the patch image and where an absolute value of a difference between the density of the patch image detected by the image density sensor and the reference density of the patch image is less than a first threshold value, (ii) set the lower limit value of the target toner density into a second lower limit value that is less than the first lower limit value in a case where the density of the patch image detected by the image density sensor is higher than the reference density of the patch image and where the absolute value of the difference between the density of the patch image detected by the image density sensor and the reference density of the patch image is equal to or greater than the first threshold value and is less than a second threshold value that is greater than the first threshold value, and (iii) set the lower limit value of the target toner density into a third lower limit value that is less than the second lower limit value in a case where the density of the patch image detected by the image density sensor is higher than the reference density of the patch image and where the absolute value of the difference between the density of the patch image detected by the image density sensor and the reference density of the patch image is equal to or greater than the second threshold value.

2. The image forming apparatus according to claim 1, wherein, in a case where a value of relative humidity around the development device is equal to or greater than a predetermined value, the controller is able to execute the mode, and wherein, in a case where the value of relative humidity around the development device is less than the predetermined value, the controller is restricted in execution of the mode.

3. The image forming apparatus according to claim 1, wherein, in a case where a value of average image ratio of a toner image formed by the image forming unit is equal to or greater than a predetermined value, the controller is able to execute the mode, and wherein, in a case where the value of average image ratio is less than the predetermined value, the controller is restricted in execution of the mode.

4. The image forming apparatus according to claim 1, wherein, in a case where a total amount of the developer supplied to the developer container by the developer replenishment unit has reached a predetermined amount, the controller is able to execute the mode, and wherein, in a case where the total amount of the developer supplied to the developer container by the developer replenishment unit has not reached the predetermined amount, the controller is restricted in execution of the mode.

5. The image forming apparatus according to claim 1, wherein the controller determines the amount of the developer supplied to the developer container by the developer replenishment unit on a basis of information regarding an amount of toner consumption due to image forming by the image forming unit, on a basis of the toner density, detected by the inductance sensor, of the developer contained in the developer container, and on a basis of the target toner density.

6. The image forming apparatus according to claim 1, wherein, the upper limit value of the target toner density taken when the lower limit value of the target toner density is set into the first lower limit value in the execution of the mode by the controller, the upper limit value of the target toner density taken when the lower limit value of the target toner density is set into the second lower limit value in the execution of the mode by the controller, and the upper limit value of the target toner density taken when the lower limit value of the target toner density is set into the third lower limit value in the execution of the mode by the controller, are equal to one another.

7. The image forming apparatus according to claim 1, wherein the controller controls the image forming unit such that the patch image is formed each time image forming of a predetermined number of sheets is performed by the image forming unit.

8. The image forming apparatus according to claim 1, further comprising:

an image transfer member onto which a toner image formed by the image forming unit is transferred from the image bearing member;

wherein the image density sensor detects the density of the patch image having been transferred from the image bearing member.

9. The image forming apparatus according to claim 8, wherein the image transfer member is a rotatable belt onto which the toner image formed on the image bearing member is transferred.

* * * * *